US011728575B1

(12) United States Patent
Luo et al.

(10) Patent No.: US 11,728,575 B1
(45) Date of Patent: Aug. 15, 2023

(54) VICTS ANTENNA BASED ON RGW STRUCTURE

(71) Applicant: Chengdu Guoheng Space Technology Engineering Co., Ltd., Chengdu (CN)

(72) Inventors: Zhongchao Luo, Chengdu (CN); Tianrui Zheng, Chengdu (CN); Renbing Huang, Chengdu (CN); He Cai, Chengdu (CN); Ran Mo, Chengdu (CN); Fawen Rong, Chengdu (CN); Zhiqing Wang, Chengdu (CN)

(73) Assignee: Chengdu Guoheng Space Technology Engineering Co., Ltd., Chengdu (CN)

( * ) Notice: Subject to any disclaimer, the term of this patent is extended or adjusted under 35 U.S.C. 154(b) by 0 days.

(21) Appl. No.: 18/106,610

(22) Filed: Feb. 7, 2023

(30) Foreign Application Priority Data

Aug. 25, 2022 (CN) ..... 202211023714.5

(51) Int. Cl.
*H01Q 21/00* (2006.01)

(52) U.S. Cl.
CPC ..... *H01Q 21/005* (2013.01)

(58) Field of Classification Search
CPC ..... H01Q 21/00; H01Q 21/005; H01Q 21/06; H01Q 3/02; H01Q 1/38; H01Q 1/50
See application file for complete search history.

(56) References Cited

U.S. PATENT DOCUMENTS

| | | | | |
|---|---|---|---|---|
| 9,899,722 | B2 * | 2/2018 | Saraf | H01Q 21/064 |
| 10,431,899 | B2 * | 10/2019 | Bily | H01Q 3/247 |
| 10,553,957 | B2 * | 2/2020 | Tubau | H01Q 5/22 |
| 10,819,022 | B1 * | 10/2020 | Milroy | H01Q 3/32 |
| 11,342,684 | B2 * | 5/2022 | Wang | H01Q 1/3233 |
| 11,450,951 | B2 * | 9/2022 | Zhang | H01Q 1/52 |

FOREIGN PATENT DOCUMENTS

| | | | |
|---|---|---|---|
| CN | 106887716 | A | 6/2017 |
| CN | 109149126 | A | 1/2019 |
| CN | 440492248 | A | 11/2019 |
| CN | 113991296 | A | 1/2022 |
| CN | 114094337 | A | 2/2022 |
| CN | 114094349 | A | 2/2022 |
| CN | 114361787 | A | 4/2022 |
| KR | 1020200070120 | A | 6/2020 |
| WO | 2014090290 | A1 | 6/2014 |
| WO | 2018095541 | A1 | 5/2018 |

* cited by examiner

*Primary Examiner* — Tho G Phan
(74) *Attorney, Agent, or Firm* — Georgi Korobanov

(57) ABSTRACT

The present application discloses a VICTS antenna based on an RGW structure, comprising an RGW feeding layer and a radiation layer arranged in sequence, wherein the RGW feeding layer comprises an RGW power splitter and a dielectric substrate for slow wave design, and the RGW power splitter is arranged under the dielectric substrate, wherein a power splitting network cover plate is arranged between the RGW feeding layer and the radiation layer, wherein the RGW power splitter comprises a feeding network and a waveguide feeding port, through which signals are input into the feeding network; the radiation layer is composed of a plurality of CTS arrays. During signal transmission, the signals are input into the feeding network through the waveguide port, and then the signals are fed into each CTS array by the feeding network; the radiation layer is configured to rotate.

5 Claims, 7 Drawing Sheets

VICTS ANTENNA BASED ON RGW STRUCTURE

CROSS-REFERENCE TO RELATED APPLICATIONS

This application claims priority to Chinese Application Serial No. 202211023714.5, filed on Aug. 25, 2022. The content of the aforementioned application, including any intervening amendments thereto, is incorporated herein by reference.

TECHNICAL FIELD

The present application relates to the field of VICTS antennas, in particular to a VICTS antenna based on an RGW structure.

BACKGROUND

As the requirements for wireless communication become higher and higher, and the level of science and technology has been greatly improved, as an antenna for sending and receiving signals in wireless communication, it is also facing various almost harsh requirements. Now, a good antenna design may have one or more special properties such as low profile, miniaturization, ultra-wideband, high gain, large power capacity, multi-dimensional scanning, and high polarization purity, but for many traditional antennas, obviously these requirements cannot be met.

The microstrip antenna is the most commonly used antenna because it is easy to manufacture, low in cost, easy to produce in large quantities, and has a very low profile, which can conform to various skin structures. Different microstrip structures can also realize performances such as ultra-wideband and multi-band. However, as the frequency increases, the loss of the microstrip antenna will increase significantly. In addition, the microstrip antenna is very sensitive to size, and a slight difference will lead to performance deviation. It is also sensitive to the selected dielectric material, which brings trouble to the processing.

Compared with the microstrip antenna, the waveguide slot antenna has much smaller loss, large power capacity, and high polarization purity. At the same time, some waveguide slot antennas also have the ability to form shapes, which can generate a main lobe with a narrow lobe width. However, in the high-frequency working frequency band, the design of the waveguide slot antenna is quite complicated, and the requirements for processing accuracy are also very high. These shortcomings undoubtedly restrict the use of the waveguide slot antenna.

In radar systems, traditional parabolic antennas are often used due to their high efficiency and good pattern characteristics. However, parabolic antennas also have the disadvantages of large size, high weight and high cost, and also have the following disadvantages.

1. The loss of active phased array antenna is high, the cost of TR components is high, the performance of large-angle scanning is poor, and the processing is difficult.

2. The parabolic antenna is bulky, not easy to carry and conform, and the beam energy is not concentrated, the directivity is poor, and it is easy to be interfered.

3. The CTS antenna beam is fixed and cannot be adjusted.

4. The power capacity of the active phased array antenna is limited, and it is easy to break down if the power is too large.

SUMMARY

The purpose of the present application is to overcome the shortcomings of the prior art and provide a VICTS antenna based on the RGW structure.

The purpose of the present application is achieved through the following technical solutions:

A VICTS antenna based on an RGW structure, comprising an RGW feeding layer and a radiation layer arranged in sequence; wherein the RGW feeding layer comprises an RGW power splitter and a dielectric substrate for slow wave design, and the RGW power splitter is arranged under the dielectric substrate, a power splitting network cover plate is arranged between the RGW feeding layer and the radiation layer; wherein the RGW power splitter comprises a feeding network and a waveguide feeding port, through which signals are input into the feeding network; wherein the radiation layer is composed of a plurality of CTS arrays; during signal transmission, the signals are input into the feeding network through the waveguide port, and then the signals are fed into each CTS array by the feeding network; the radiation layer is configured to rotate, wherein, a beam deviates from the Z-axis direction to realize the adjustable pencil beam by rotating the CTS array relative to the dielectric substrate.

Further, the RGW feeding layer adopts an RGW structure, and a plurality of isolating posts are arranged on the dielectric substrate, which are distributed on positions other than the RGW power splitter of the RGW feeding layer, the feeding network of the RGW power splitter forms a transmission ridge in the RGW feeding layer.

Further, the transmission ridge has a ridge width of $\lambda g/4$ and a height of 2 mm, where $\lambda g$ is the waveguide wavelength of the dielectric substrate, and the unit is mm.

Further, the isolating post is a column with a square bottom, and the side length is designed according to the operating frequency, and the side length is 0.8 mm-1.2 mm, and the height is also designed according to the operating frequency, the height is 2-3 mm.

Further, the interval between each unit of the CTS array is between $\lambda g/2$-$\lambda g*0.8$.

Further, both the radiation layer and the RGW feeding layer use aluminum as the metal base material.

The beneficial effect of the present application:

1. It can be implemented in any radio frequency/microwave frequency band, such as C, X, Ku, Ka, etc. In this case, it is the Ka band.

2. With adjustable pencil beam, high directivity and high aperture efficiency.

3. It has low cost (the whole machine adopts metal mechanical parts to form layers, and beam scanning can be realized without additional TR components), low profile (the overall height of the antenna does not exceed 15 mm), low loss, wide operating frequency band and insensitivity to size tolerance and other advantages.

4. The RGW structure is used, and the energy of each power splitter is concentrated, which can improve the radiation efficiency.

5. It can realize high power feeding.

BRIEF DESCRIPTION OF DRAWINGS

In order to more clearly illustrate the technical solutions in the embodiments of the present application or the prior art, the following briefly introduces the drawings that are required in the description of the embodiments or the prior art. Apparently, the accompanying drawings in the following description are only some embodiments of the present application. For those skilled in the art, other drawings can also be obtained according to the structures shown in these drawings without any creative effort.

DETAILED DESCRIPTION

It should be understood that the specific embodiments described here are only used to explain the present application, not to limit the present application.

The technical solutions in the embodiments of the present application will be clearly and completely described below in conjunction with the drawings in the embodiments of the present application. Apparently, the described embodiments are only some of the embodiments of this application, not all of them. Based on the embodiments in the present application, all other embodiments obtained by a person skilled in the art without creative efforts fall within the protection scope of the present application.

Figure 1:
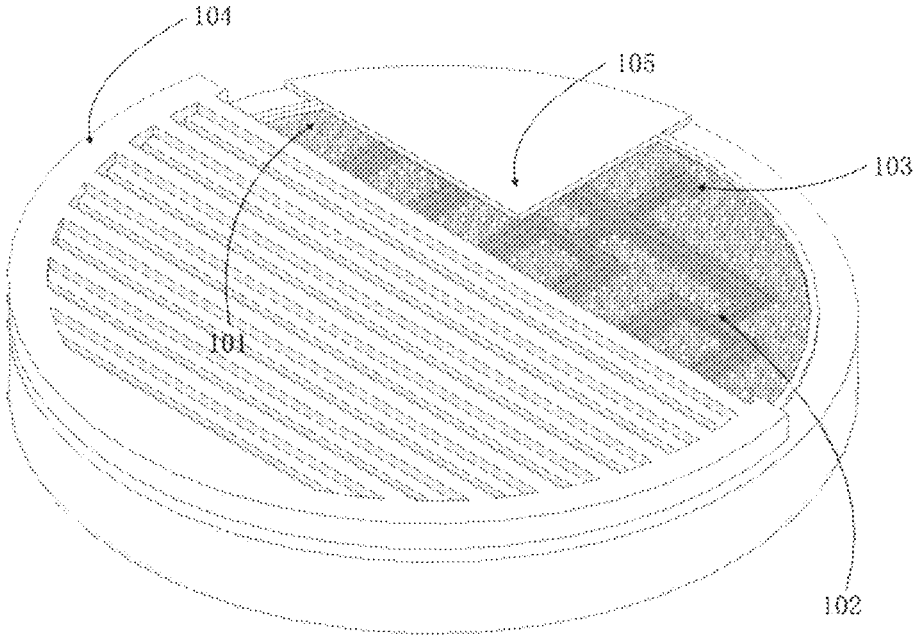
FIG. 1 is a structural diagram of the RGW-VICTS antenna of the present application.

In this embodiment, as shown in FIG. 1, a VICTS antenna based on an RGW structure comprises an RGW feeding layer and a radiation layer arranged in sequence.

The RGW feeding layer comprises an RGW power splitter 108 and a dielectric substrate 101, and the RGW power splitter 108 is arranged under the dielectric substrate 101. The RGW power splitter 108 comprises a feeding network 102 and a waveguide feeding port 103, signals are input into the feeding network 102 through the waveguide feeding port 103. The radiation layer is composed of a plurality of CTS arrays 104. During signal transmission, the signals are input into the feeding network 102 through the waveguide port, and then the signals are fed into each CTS array 104 by the feeding network 102; the radiation layer is configured to rotate, wherein a beam deviates from the Z-axis direction to realize the adjustable pencil beam by rotating the CTS array 104 relative to the dielectric substrate 105. The CTS array 104 is composed of radiating lateral branches, and the structure has broadband characteristics.

Figure 2:
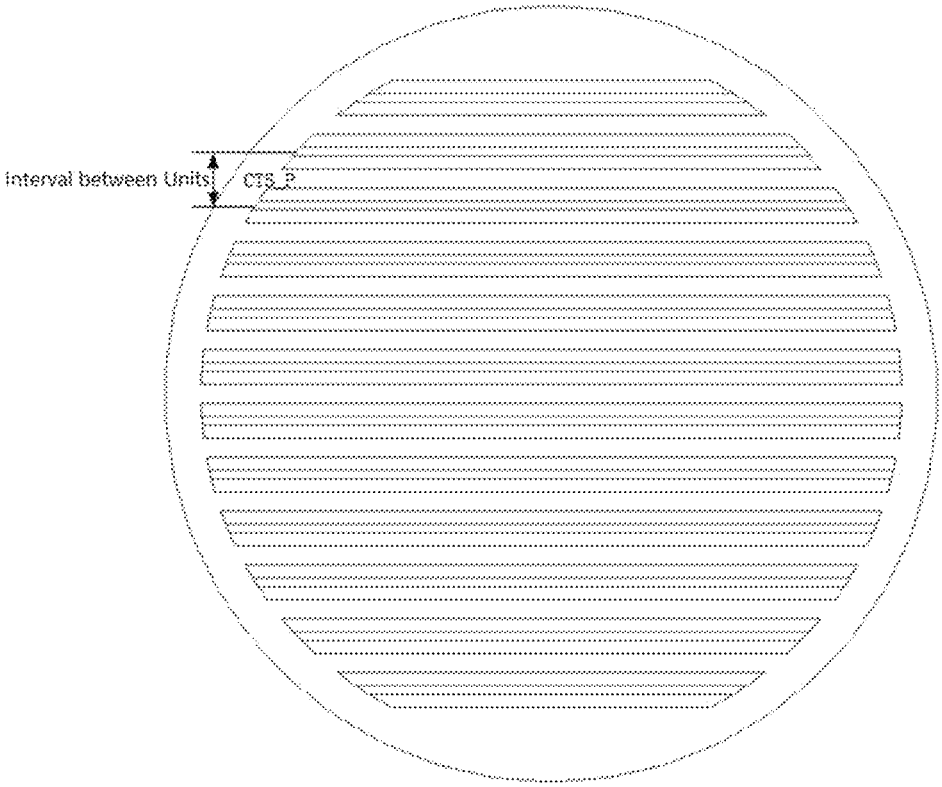
FIG. 2 is a schematic diagram of the CTS antenna surface of the radiation layer.

In another embodiment, as shown in FIG. 2, the radiation layer of the antenna is composed of CTS units, and the interval between each unit is CTS_P=g/2.

Figure 3:
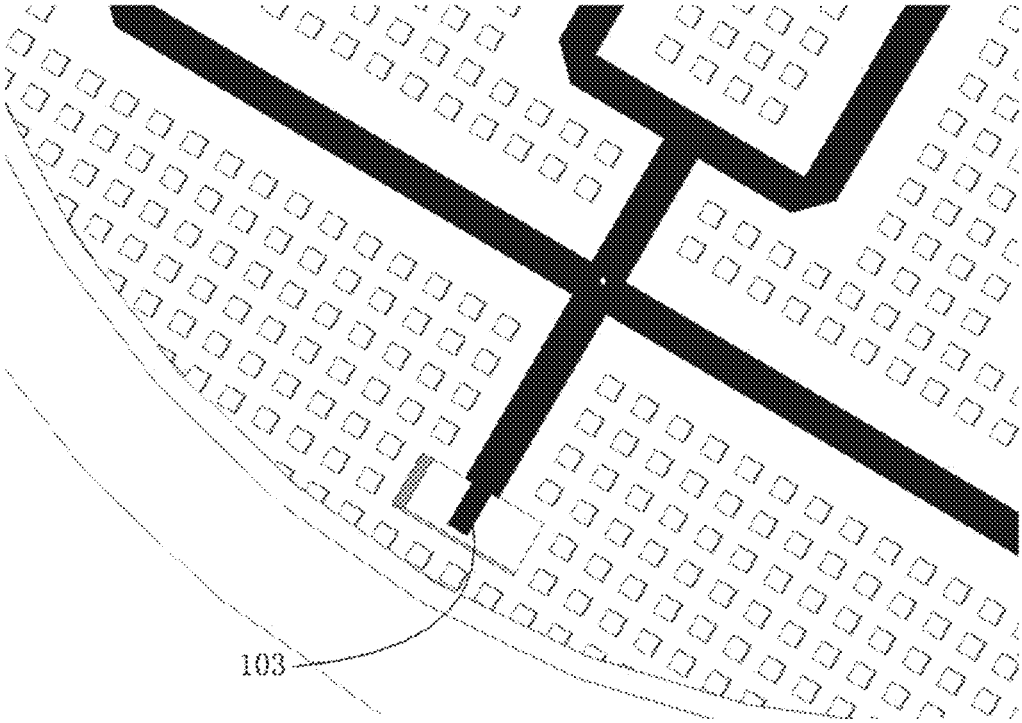
FIG. 3 is a schematic diagram of the waveguide feeding port of the feeding layer.
Figure 4:
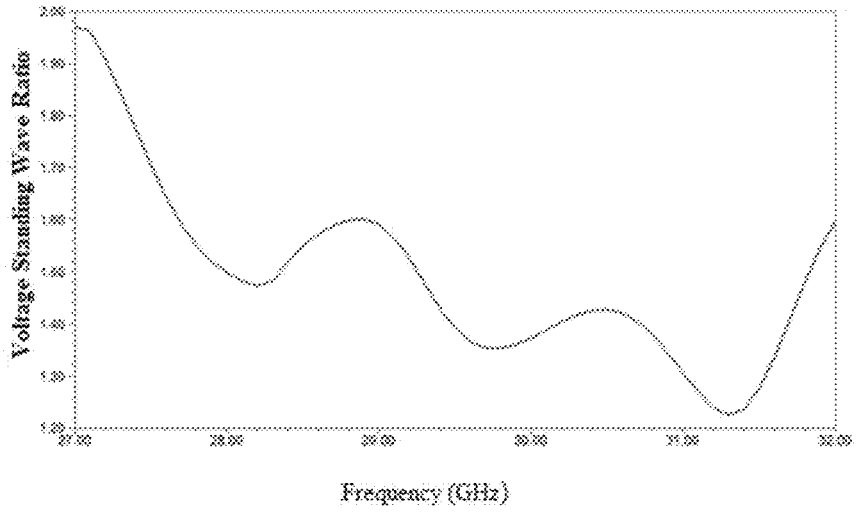
FIG. 4 is a standing wave curve of the waveguide feeding port.

In another embodiment, as shown in FIG. 3 and FIG. 4, the entire feeding network 102 of the antenna adopts an RGW structure, which has high isolation and low transmission loss, and is suitable for high-power microwave devices.

Figure 5:
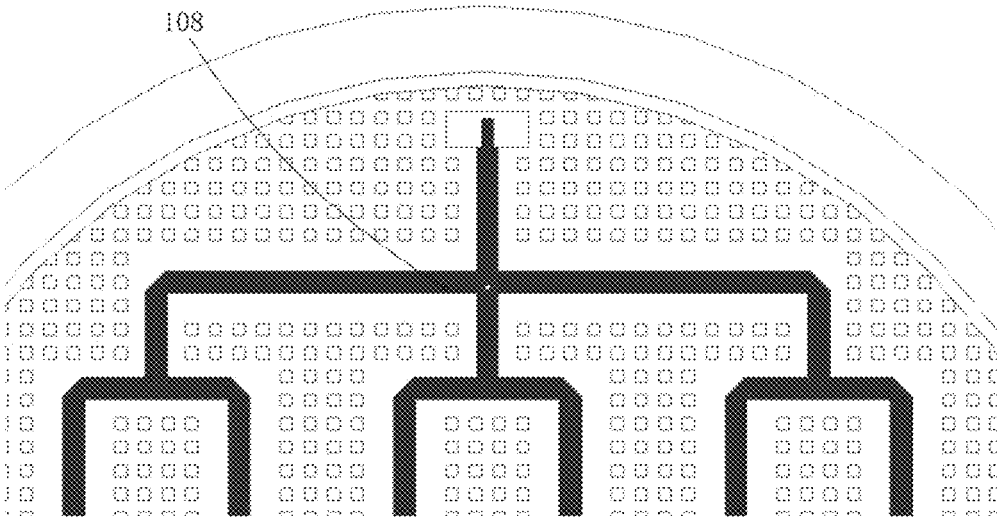
FIG. 5 is a schematic structural diagram of the RGW power splitter in the feeding layer.
Figure 6:
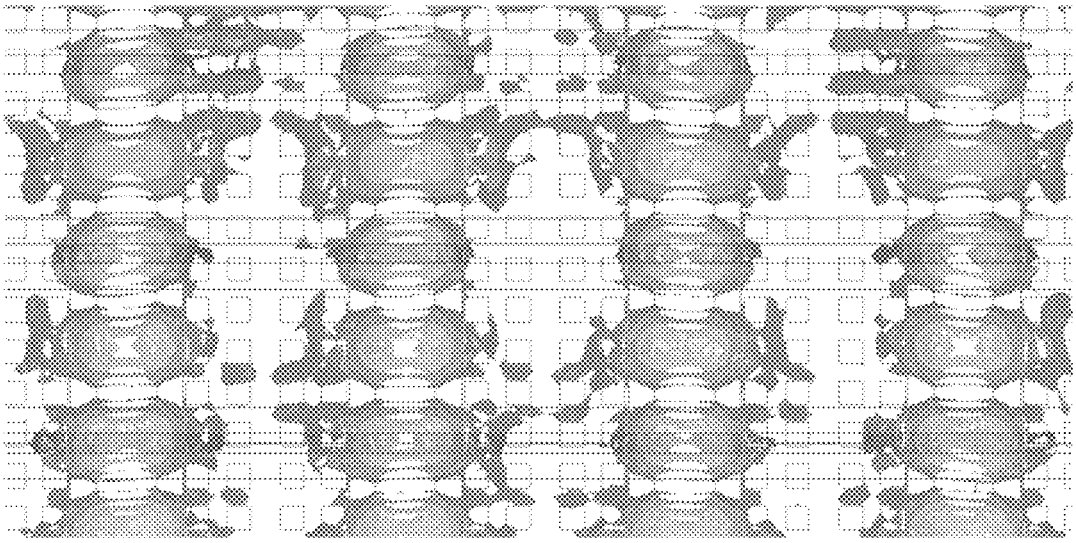
FIG. 6 is a schematic diagram of RGW transmission.

In another embodiment, as shown in FIG. 5 and FIG. 6, the RGW power splitter 108 is used for feeding each CTS unit, which can effectively reduce the crosstalk between each signal, and the energy is basically concentrated on the transmission ridge.

Figure 7:
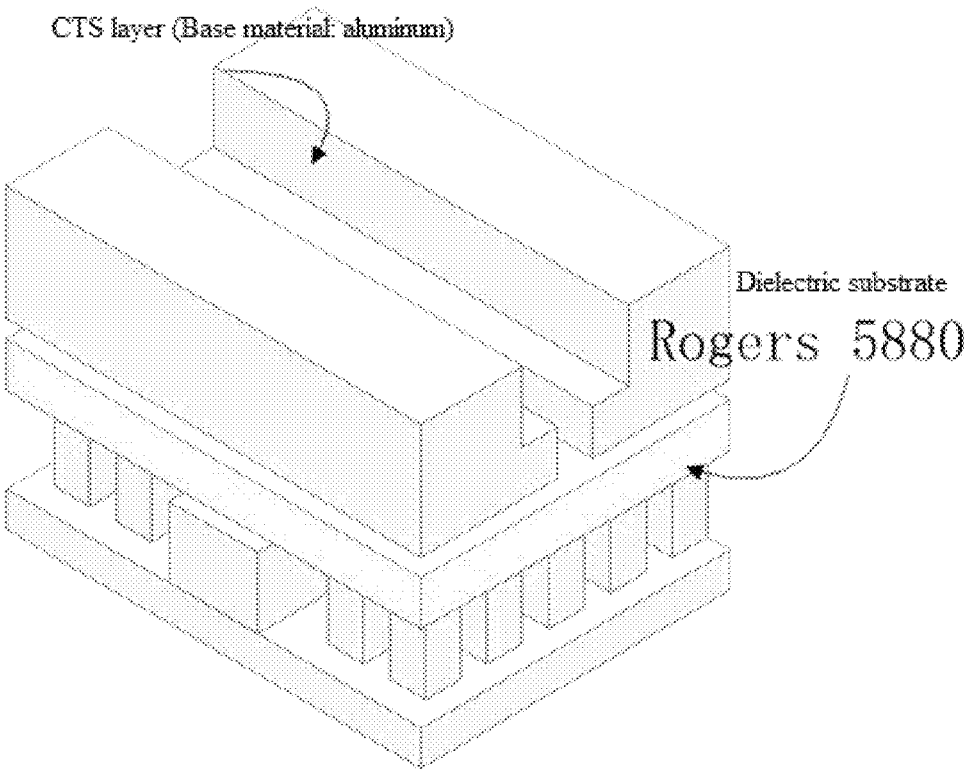
FIG. 7 is a partial schematic diagram of the antenna body level.

In another embodiment, as shown in FIG. 7, the antenna body is divided into three layers, the first layer is the feeding layer, which is realized by milling a whole piece of aluminum material, and the purpose is to realize the feeding network 102 with high isolation; The second layer is Rogers 5880 plate with a thickness of 1.524 mm, the purpose is to realize slow wave feeding; the third layer is also the radiation layer cut out by aluminum milling, the purpose is to realize the radiation of the antenna.

Figure 8:
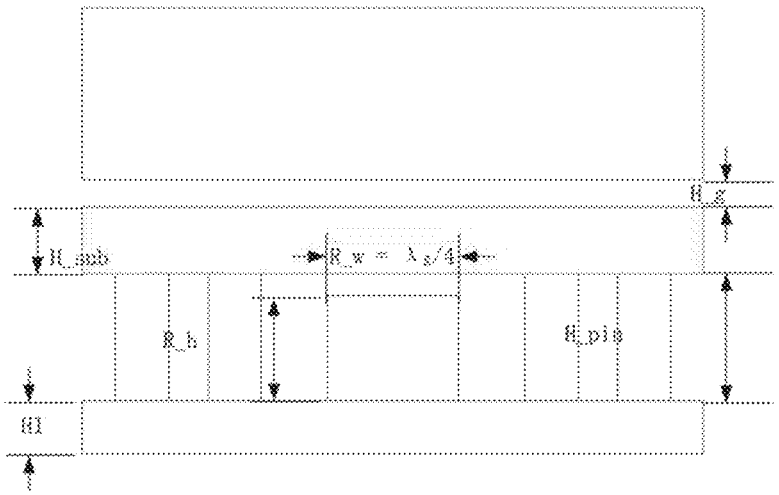
FIG. 8 is a partial front view of layers of the antenna body.

In another embodiment, as shown in FIG. 8, the feeding layer is composed of ridge waveguides and isolating columns. Through this structure, the input energy can be confined near the transmission ridge, thereby achieving high isolation between the two ports. In this embodiment, take the ridge width λ g/4, 1.5 mm≤R_h≤2.5 mm, the side length of the isolating column 0.5 mm≤s≤1.5 mm, the height 2 mm≤H_pin≤3 mm, and the height of the dielectric substrate 105 H_sub=1.524 mm. Since the feeding layer and the radiation layer should rotate relative to each other, there is a gap of 0.5 mm≤H_g≤1.5 mm between them, and the thickness H1 of the bottom plate is generally 1 mm.

Figure 9:
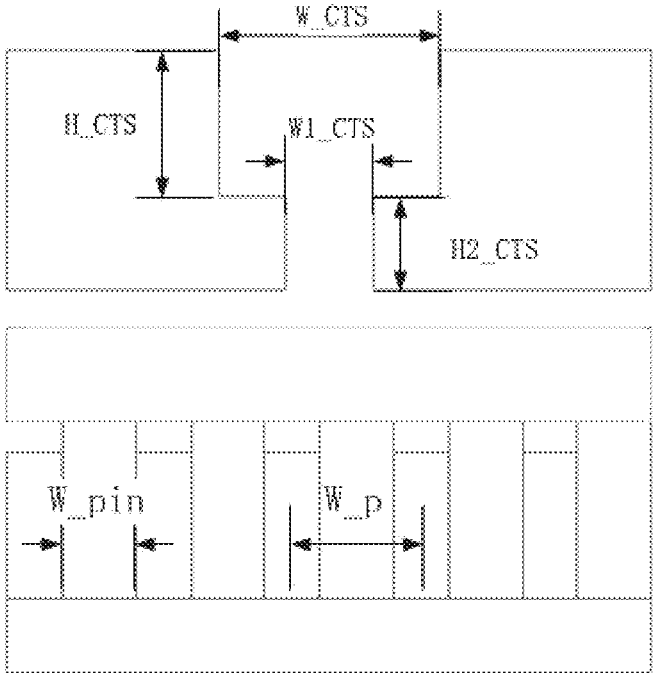
FIG. 9 is a partial side view of the layers of the antenna body.

In another embodiment, as shown in FIG. 9, the CTS unit is implemented in two stages, and one-stage or multi-stage implementations can be included in the actual design process.

Figure 10:
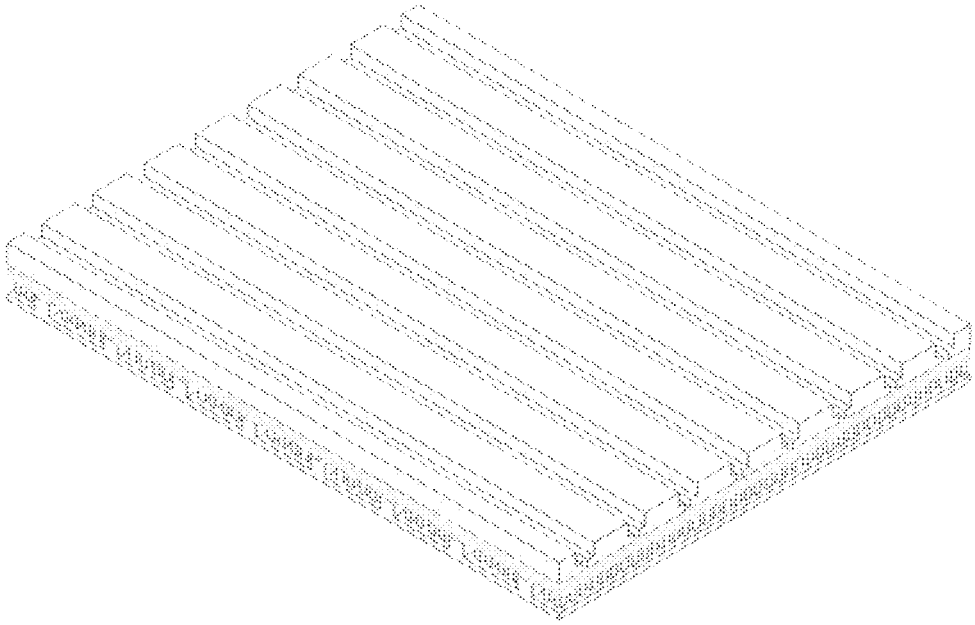
FIG. 10 is a schematic diagram of a CTS array.
Figure 11:
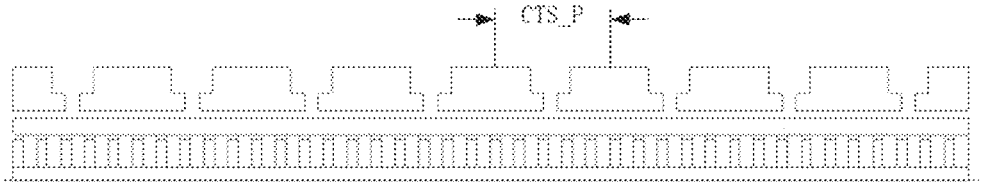
FIG. 11 is a side view of the CTS array.
Figure 12:
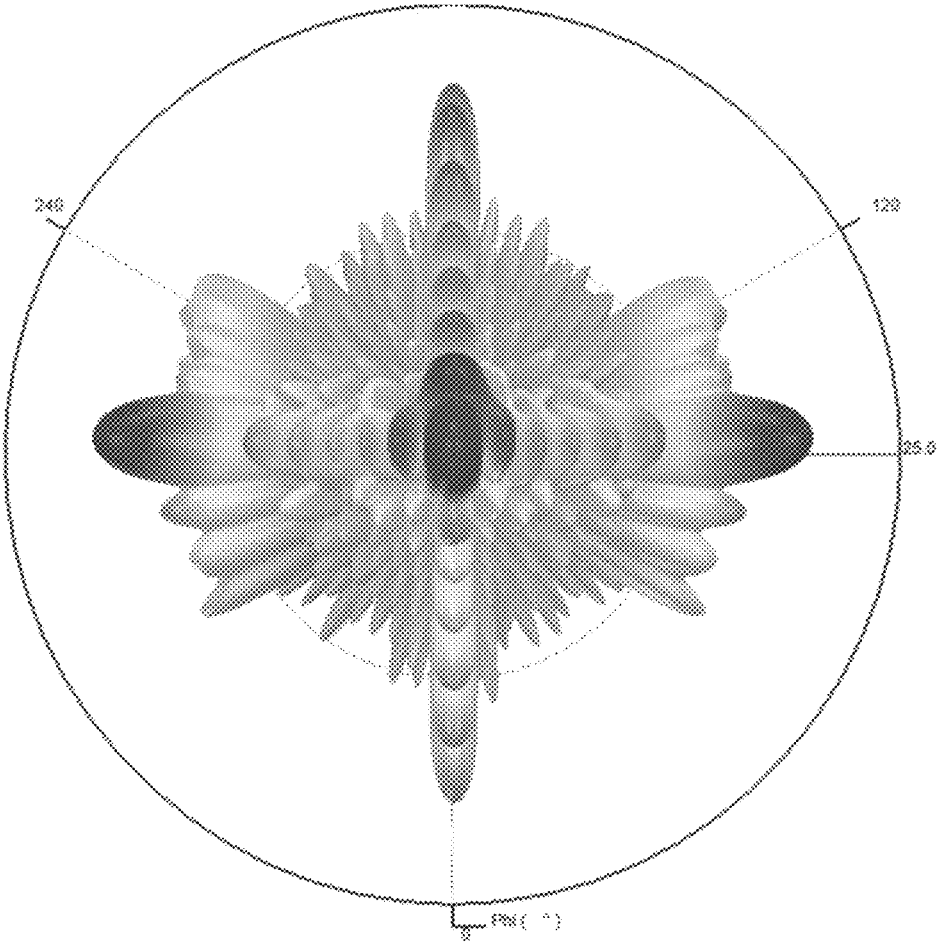
FIG. 12 is a diagram of the antenna gain of the present application.

In another embodiment, the 8*8 array shown in FIG. 10 and FIG. 11 is the middle part intercepted from the whole machine, and the antenna CTS array period is CTS_P=λg/2, and FIG. 12 is an antenna gain diagram for the direction of the antenna at 30 GHz.

It should be noted that, for the foregoing method embodiments, for the sake of simple description, they are expressed as a series of action combinations. However, those skilled in the art should know that the present application is not limited by the sequence of actions described, because according to the present application, certain steps can be performed in other orders or simultaneously. Secondly, those skilled in the art should also know that the embodiments described in the specification belong to preferred embodiments, and the actions and units involved are not necessarily required by the present application.

In the foregoing embodiments, the descriptions of each embodiment have their own emphases, and for parts not described in detail in a certain embodiment, reference may be made to relevant descriptions of other embodiments.

Those skilled in the art can understand that all or part of the processes in the methods of the above embodiments can be implemented by instructing related hardware through computer programs. The program can be stored in a computer-readable storage medium. When the program is executed, it may include the procedures of the embodiments of the above-mentioned methods. Wherein, the storage medium may be a magnetic disk, an optical disk, a ROM, a RAM or the like.

The above disclosures are only preferred embodiments of the present application, which certainly cannot limit the scope of the present application. Therefore, equivalent changes made according to the claims of the present application still fall within the scope of the present application.

What is claimed is:

1. A VICTS antenna based on an RGW structure, comprising an RGW feeding layer and a radiation layer arranged in sequence; wherein the RGW feeding layer comprises an RGW power splitter and a dielectric substrate for slow wave design, and the RGW power splitter is arranged under the dielectric substrate, a power splitting network cover plate is arranged between the RGW feeding layer and the radiation layer; wherein the RGW power splitter comprises a feeding network and a waveguide feeding port, through which signals are input into the feeding network; wherein the radiation layer is composed of a plurality of CTS arrays; during signal transmission, the signals are input into the feeding network through the waveguide port, and then the signals are fed into each CTS array by the feeding network; the radiation layer is configured to rotate, wherein a beam deviates from the Z-axis direction to realize the adjustable pencil beam by rotating the CTS array relative to the dielectric substrate, wherein the RGW feeding layer adopts an RGW structure, and a plurality of isolating posts are arranged on the dielectric substrate, which are distributed on positions other than the RGW power splitter of the RGW feeding layer, the feeding network of the RGW power splitter forms a transmission ridge in the RGW feeding layer.

2. The VICTS antenna based on an RGW structure according to claim 1, wherein the transmission ridge has a ridge width of λg/4 and a height of 2 mm, where λg is the waveguide wavelength of the dielectric substrate, and the unit is mm.

3. The VICTS antenna based on an RGW structure according to claim 1, wherein the isolating post is a column with a square bottom, and the side length is designed according to the operating frequency, and the side length is 0.8 mm-1.2 mm, and the height is also designed according to the operating frequency, the height is 2-3 mm.

4. The VICTS antenna based on an RGW structure according to claim 1, wherein the interval between each unit of the CTS array is between λg/2-λg*0.8.

5. The VICTS antenna based on an RGW structure according to claim 1, wherein both the radiation layer and the RGW feeding layer use aluminum as the metal base material.

* * * * *